United States Patent [19]

Castanino et al.

[11] 3,986,184

[45] Oct. 12, 1976

[54] METHOD AND APPARATUS FOR DETERRING FALSE ALARMS

[75] Inventors: Joseph J. Castanino, East Bridgewater; John W. Lotus, Avon; Alfred J. Meade, Franklin, all of Mass.

[73] Assignee: False Alarm Deterrent Corporation, E. Bridgewater, Mass.

[22] Filed: June 17, 1975

[21] Appl. No.: 587,634

[52] U.S. Cl. ..... 340/304; 340/287

[51] Int. Cl.[2] ..... G08B 29/00; G08B 25/00

[58] Field of Search ..... 340/304, 149 A

[56] References Cited

UNITED STATES PATENTS

| | | | |
|---|---|---|---|
| 1,861,243 | 5/1932 | Rothman et al. | 340/304 |
| 2,301,989 | 11/1942 | Zamborsky | 340/304 |
| 3,325,800 | 6/1967 | Messick | 340/304 |
| 3,639,905 | 2/1972 | Yaida et al. | 340/149 A |
| 3,877,005 | 4/1975 | Apgar | 340/304 |
| 3,885,236 | 5/1975 | McNair et al. | 340/304 |
| 3,886,537 | 5/1975 | Mann et al. | 340/304 |

*Primary Examiner*—Glen R. Swann III
*Attorney, Agent, or Firm*—Richard J. Birch

[57] ABSTRACT

A plurality of finger operated button switches are employed in conjunction with a logic circuit to control the mechanical activation of a conventional alarm box mechanism. When the finger button switches are pressed to activate the alarm, the user's fingerprints are retained on the switch buttons. Upon actuation of the alarm, the fingerprint bearing button switches are retracted to a position in which they are inaccessible to the alarm user. An electrical "flesh" sensor is provided on at least one finger button to prevent actuation of the alarm by means other than a human finger. In the event of a power failure, the conventional alarm mechanism can be actuated by mechanical pressure on a thumb button switch. In the preferred embodiment, the finger actuated button switches are located within a housing that can be retrofitted to existing alarms such as, fire alarm telegraph boxes.

32 Claims, 7 Drawing Figures

METHOD AND APPARATUS FOR DETERRING FALSE ALARMS

BACKGROUND OF THE INVENTION

The present invention relates to alarm systems in general and more particularly, to a method and apparatus for deterring false alarms.

The alarm industry has been troubled with the problem of false alarms practically since the introduction of the ubiquitous fire alarm telegraph box. The early patent literature is replete with various proposals to deter people from turning in false alarms. See generally U.S. Patent Class 340, Subclass 304. Physical restraint devices, such as, wrist engaging handcuffs, locking telephone booths and the like have been suggested as a means to discourage false alarms. The physical restraint devices present obvious problems with respect to the legitimate user of the alarm box and expose the alarm company to potential liability for injuries to the alarm user.

Other false alarm deterrent devices have operated on the theory of identifying the user of the alarm box. The art contains a number of examples of identification systems utilizing photographic means to record the identify of the alarm user. In these systems, the camera may be located at the alarm box or at a remote site. In either location, the photographic system can be defeated merely by blocking the camera lens.

Various types of marking devices have been suggested to provide a readily identifiable mark on the user of the alarm. Alarm boxes which dispense an indelible ink or other marking liquid or powder appear in the patent literature. These devices depend on the determent effect of the possible identification of the alarm user at a later time. In practice, such devices have had a relatively poor record with respect to apprehending persons who turn-in false alarms because the identification must be made under close physical as well as temporal proximity to the false alarm.

Recent emphasis in the field of false alarm deterrence has been directed to voice-activated call boxes. Over a thousand such boxes have been installed in New York City. However, voice-activated boxes which allow the dispatcher to talk directly to the alarm sender have tended to increase the number of "malicious false alarm": N.Y. Times, Dec. 20, 1974, Pages 1 and 38.

SUMMARY OF THE INVENTION

It is accordingly, a general object of the present invention to provide an improved method and apparatus for deterring false alarms.

It is a specific object of the invention to provide a method and apparatus for deterring false alarms which utilize the alarm sender's fingerprint "signature" as the identification element.

It is still another object of the invention to provide an alarm activation device which distinguishes between human fingers and inanimate objects in order to prevent improper activation of the alarm.

It is a feature of the invention that it can be readily retrofitted to the millions of existing fire alarm telegraph boxes in this and other communities.

It is still another feature of the invention that the conventional alarm activation mechanism of the alarm box can be operated in the event of an electrical power failure.

It is a further feature of the invention that the sender's fingerprint signature is protected from obliteration or other physical damage as soon as the alarm is activated.

BRIEF DESCRIPTION OF THE DRAWINGS

These objects and features and other objects and features will best be understood from a detailed description of a preferred embodiment of the invention, selected for purposes of illustration and shown in the accompanying drawings in which.

DESCRIPTION OF THE PREFERRED EMBODIMENT

Figure 1:
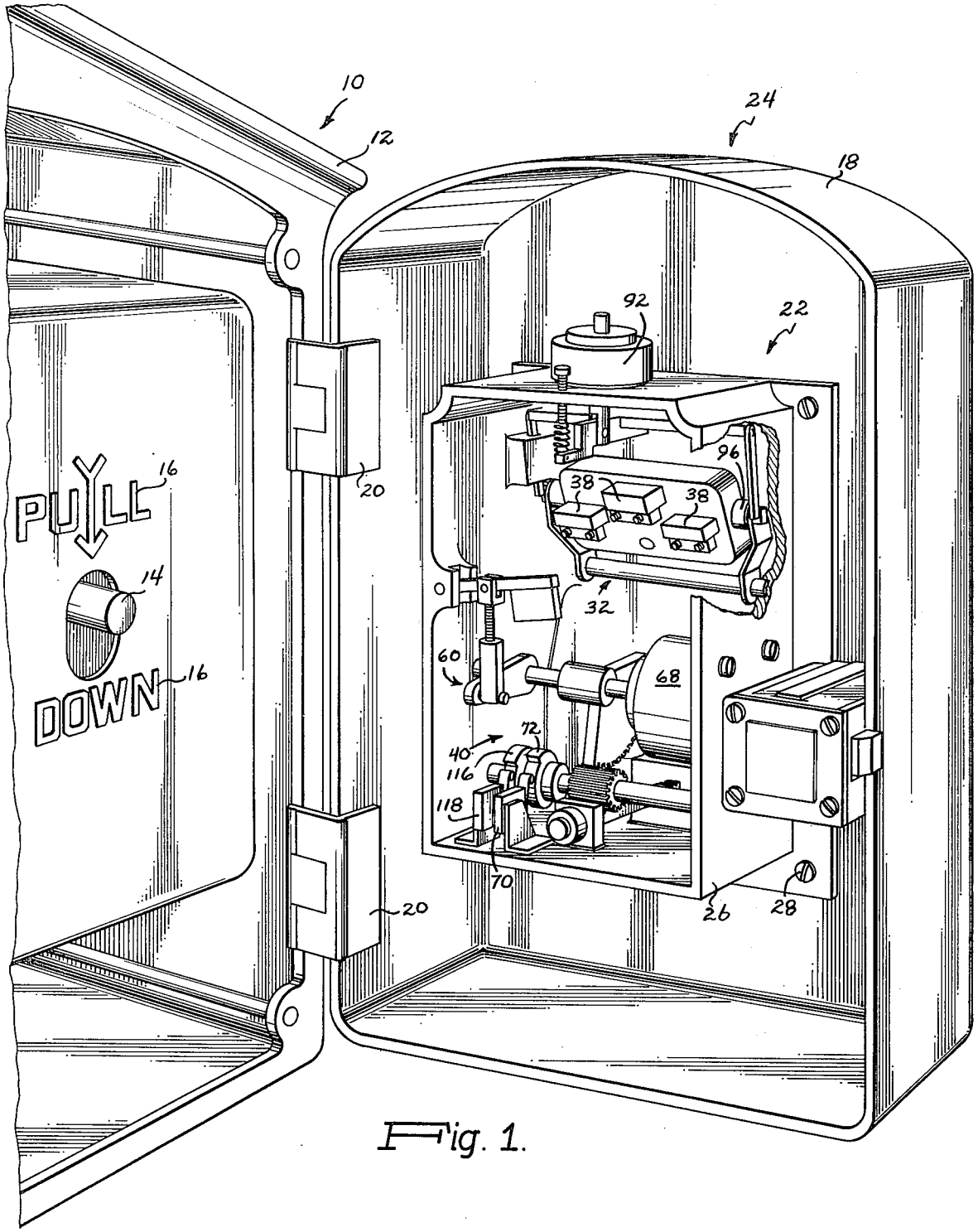
FIG. 1 is a view in perspective of the false alarm deterrent apparatus of the present invention mounted within a cover which is pivotally secured to a conventional fire alarm telegraph box.

Turning now to the drawings, there is shown a conventional alarm box such as, a fire alarm telegraph box, indicated generally by the reference numeral 10. The alarm box 10 comprises a housing 12 within which is mounted a standard alarm telegraph sending unit (not shown) which is actuated by moving a mechanical trip lever 14 in a downwardly direction as indicated by the alarm actuation direction indicia 16. An alarm box cover 18 is pivotally mounted on the alarm box housing 12 by means of conventional hinges 20. The cover 18 protects the alarm box sending unit and trip lever 14 from the deleterious effects of the environment.

The false alarm deterrent apparatus of the present invention, indicated generally by the reference numeral 22 in FIG. 1, is designed to fit within a conventional alarm box cover in order to permit retrofitting of existing alarm boxes as well as for use with new alarm boxes. The false alarm deterrent apparatus 22 can be installed in existing alarm box covers with suitable mechanical modification of the cover or it can be installed in a new cover which is then submitted for the existing alarm box cover in the field. The latter procedure is obviously preferable in terms of time and ease of installation. Accordingly, for retrofit applications, the false alarm deterrent apparatus 22 normally would be supplied as part of an entire replacement cover assembly, indicated generally by the reference numeral 24 in FIG. 1. For new alarm boxes the cover assembly 24 is furnished as part of the alarm box.

The major components of the false alarm deterrent apparatus 22 can best be seen in FIGS. 1–5. A number of the components are mounted within a housing 26 that is secured to the inside surface of the alarm box cover 18 by means of conventional fasteners 28. A retractable and removable finger button assembly, indicated generally by the reference numeral 30, is pivotally mounted within the housing 26. The finger button assembly 30 contains a plurality of finger buttons 32 each of which has a fingerprint receiving surface 34. At least one of the finger buttons 32 has a pair of electrical contacts 36 which form part of a flesh sensor circuit which will be described below in connection with FIGS. 6 and 7. Each finger button 32 also has associated therewith a microswitch 38 which is actuated by pressure upon the finger button 32. The purpose of the microswitches 38 also will be discussed below in connection with FIGS. 6 and 7.

Referring specifically to FIGS. 1 through 4, a thumb button gear train assembly, indicated generally by the reference numeral 40, is mounted with the apparatus housing 26. The thumb button gear train assembly 40 mechanically actuates the conventional alarm box trip lever 14 under certain conditions when the alarm sender presses thumb button 42. The thumb button gear trained assembly comprises the thumb button 42 which is secured to a rack 44 that is slidably mounted with respect to the housing 26. An adjusting stop collar 46 and spring 48 are used to position the thumb button 42 with respect to the front surface 50 of the alarm box cover 18.

Figure 3:
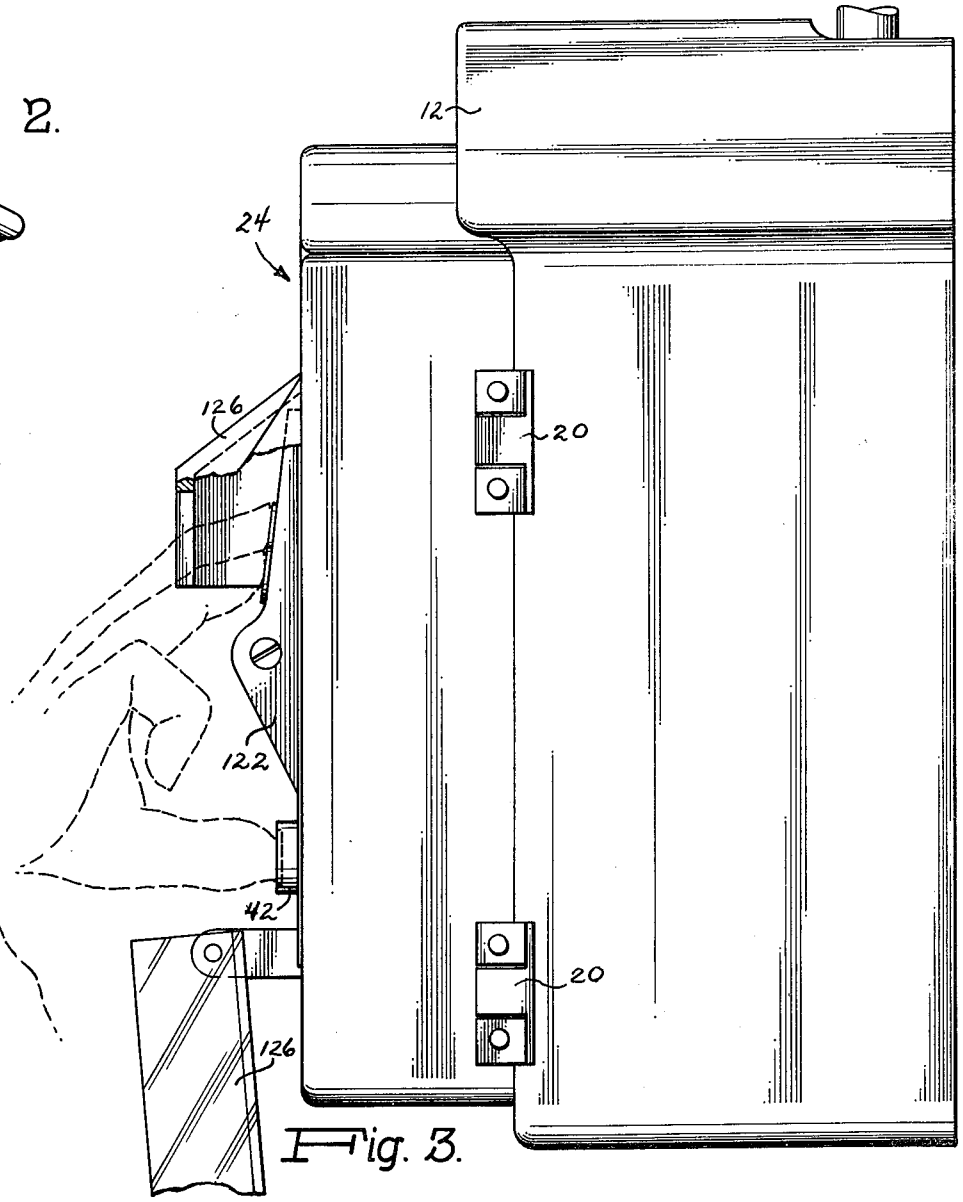
FIG. 3 is a side view of the door, alarm box and sender's hand shown in FIG. 2.
Figure 2:
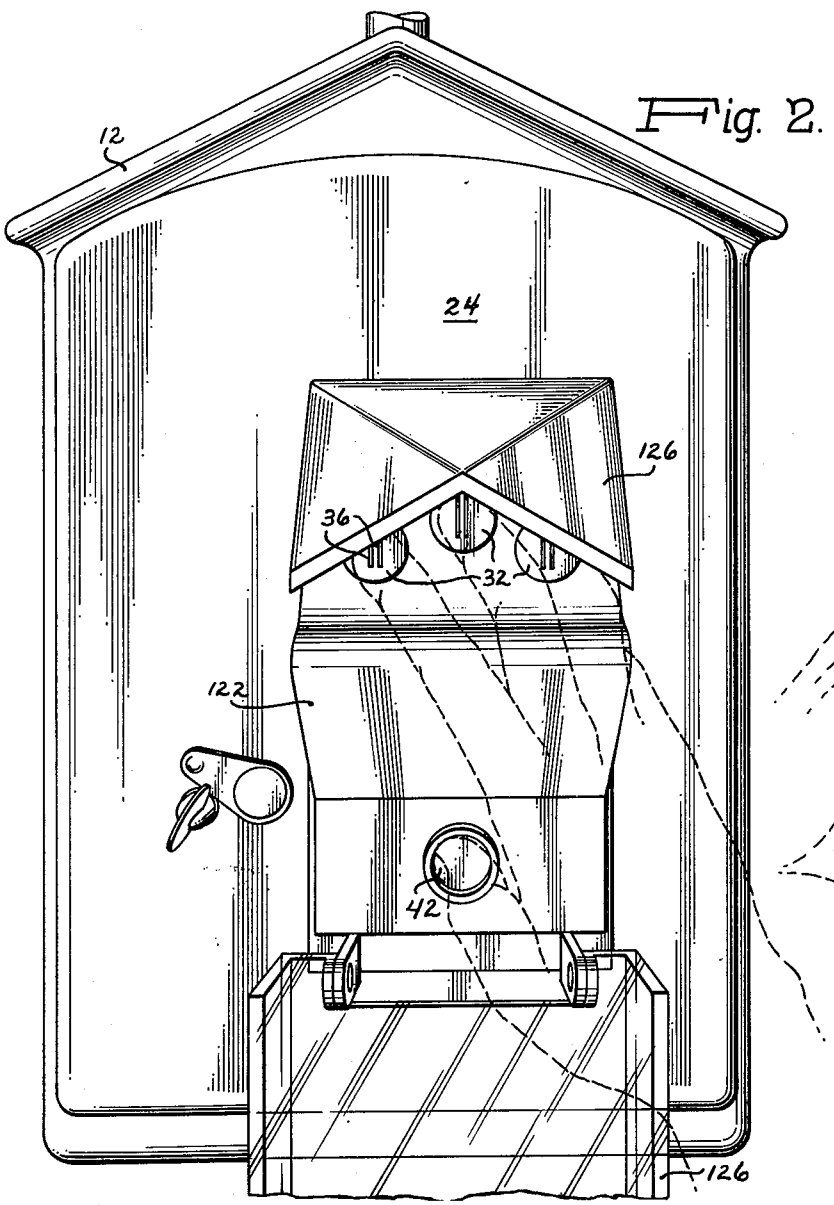
FIG. 2 is a front view of the door and alarm box of FIG. 1 showing an alarm sender's hand in dotted form in the act of depressing alarm activating finger buttons.
Figure 4:
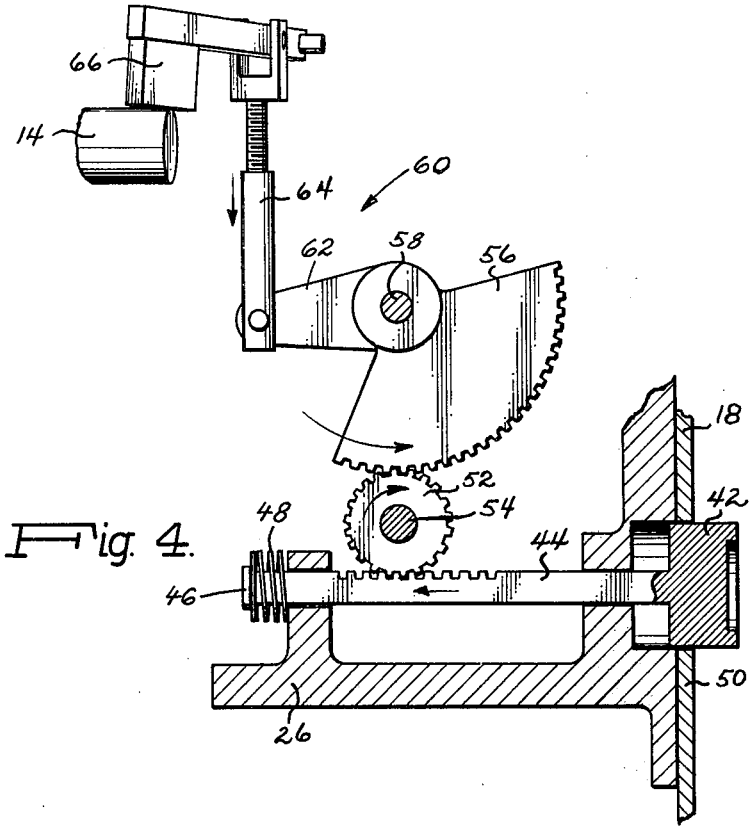
FIG. 4 is a view in side elevation and partial section showing a thumb button operated gear train for mechanically actuating the alarm mechanism of a conventional fire alarm telegraph box.

When the thumb button is pressed by the alarm sender's thumb, as shown by the dotted hand in FIGS. 2 and 3, rack 44 moves inwardly with respect to the alarm box cover front surface 50 and to the left as viewed in FIG. 4. The movement of rack 44 is transferred through a pinion gear 52 mounted on shaft 54 to a rotatably mounted gear segment 56. The rotational movement of the gear segment 56 is transmitted through a shaft 58 to a swivel linkage assembly indicated generally by the reference numeral 60. The swivel linkage assembly 60 comprises a lever 62 that is secured to the gear segment shaft 58, a vertically adjustable arm unit 64 which is pivotally mounted on lever 62 and an alarm actuator lever 66 that is secured to the vertically adjustable arm 64. The vertically adjustable arm 64 is adjusted so that the alarm actuator lever 66 engages the trip lever 14 of the conventional alarm box when the thumb button gear train assembly is in the position shown in FIG. 4.

It can be seen from an examination of FIG. 4 that when the thumb button 42 is pressed by the alarm sender it moves to the left as viewed in FIG. 4. This motion is translated, as shown by the directional arrows, through the thumb button gear train assembly to produce a downward movement of the alarm actuator lever 66 thereby tripping the alarm box trip lever 14.

It has been mentioned previously that one of the features of the false alarm deterrent apparatus of the present invention is that it operates in a "fail-safe" mode in the event of power failure. If power is available to the false alarm deterrent apparatus 22 either through a self-contained battery supply (not shown) or from the power mains, the operation of the thumb button gear train assembly 40 is controlled by an electromagnetically actuated brake 68. The brake 68 is energized i.e. applied by means of a cam operated microswitch 70 (SW2 in FIG. 7) that is mounted on the pinion gear shaft 52.

Looking at FIGS. 1 and 4, as the pinion gear shaft 54 rotates upon actuation of the thumb button rack 44, cam 72 closes microswitch 70 after a predetermined degree of rotation. When microswitch 70 is closed, power is applied to the electromagnetic brake 68 thereby preventing further movement of the thumb button gear train assembly 40. In other words, the electromagnetic actuated brake 68 prevents the tripping of the alarm box trip lever 14 through the thumb button gear train assembly as long as the brake is engaged i.e. energized. The electromagnetic brake 68 is released if a human finger electrically bridges the flesh sensor contacts 36 on finger button 32 and if all of the finger buttons are pressed at the same time. The operation of the electrical circuitry to perform this function will be discussed below in connection with FIG. 7.

It will be appreciated that in the event of a power failure, the electromagnetically actuated brake 68 remains disengaged so that the thumb button gear train assembly 40 can be operated to actuate the alarm box trip lever 14. This arrangement provides the desired fail-safe mode of operation in the event of a power supply failure or an outage on the power mains.

Figure 5:
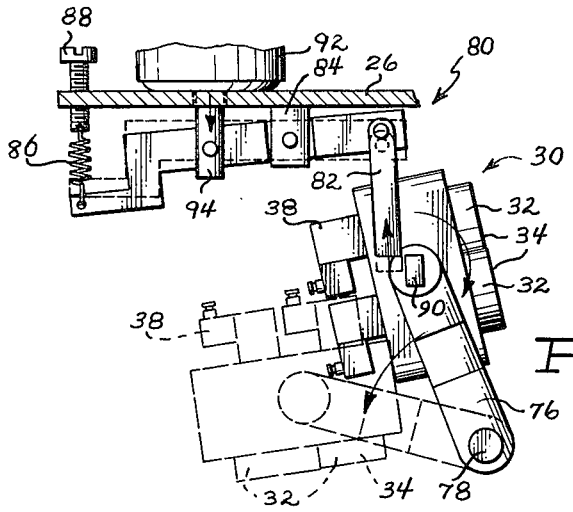
FIG. 5 is a view in side elevation and partial section showing the finger button, fingerprint retaining device of the present invention in the operative position by means of solid lines and in the retracted, fingerprint retaining position by means of dashed lines.

Having described in detail the structure and operation of the thumb button gear train assembly 40, the structure and and operation of the retractable and removable finger button assembly 30 will now be described in detail. Referring to FIGS. 1 and 5, the finger button assembly 30 is shown in the operative position in FIG. 5 by the solid lines and in the retracted position by the dashed lines. The retractable and removable finger button assembly 30 comprises the previously mentioned finger buttons 32, the flesh sensor contacts 36 and the microswitches 38. The finger button assembly 30 is pivotally mounted on a pivot yoke assembly 74 having a pair of yoke arms 76 and a yoke shaft 78 which is rotatably mounted with respect to the housing 26.

The finger button assembly and yoke assembly are held in the operative position by a solenoid actuated latching assembly, indicated generally by the reference numeral 80. The latching assembly 80 includes a spring loaded latch arm 82 which is pivotally mounted with respect to the housing 26 by means of pivot 84. The latch arm 82 is spring loaded in the downwardly or "latched" direction, as shown in FIG. 5, by tension spring 86. The amount of the spring loading applied to the latch arm can be adjusted by rotating the tension spring adjusting screw 88. The latch arm 82 is released from a yoke assembly stop 90 upon energization of a solenoid 92. When the solenoid is energized, solenoid arm 94 moves in a downwardly direction and the latch arm 82 moves in an upwardly direction beyond stop 90 thereby allowing the yoke assembly to pivot about the yoke shaft 78 in a counter clock-wise direction.

Access to the alarm sender's fingerprints which appear on the finger buttons is prevented by retracting the finger button assembly when the alarm is sent. In addition, the finger button assembly is rotated in a clock-wise direction, as shown in FIG. 5 to place the fingerprint receiving surfaces 34 out of reach of the alarm sender. A torsion spring 96 is provided on the finger button assembly to cause the assembly to rotate upon release of the latching assembly 80. When this occurs, the finger buttons 32 are rotated to the dashed position shown in FIG. 5. In this position they are inaccessible to the alarm user and, therefore, the user's fingerprints on the fingerprint receiving surfaces 34 cannot be obliterated or destroyed.

Figure 6:
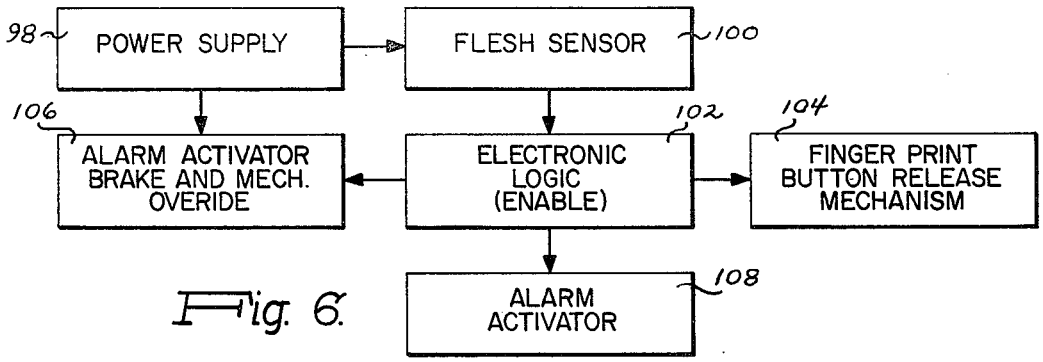
FIG. 6 is a block diagram showing the interrelationship of the electrical and mechanical elements of the false alarm deterrent apparatus; and, FIG. 7 is a schematic diagram of the electrical circuits of the apparatus including the "flesh sensor".
Figure 7:
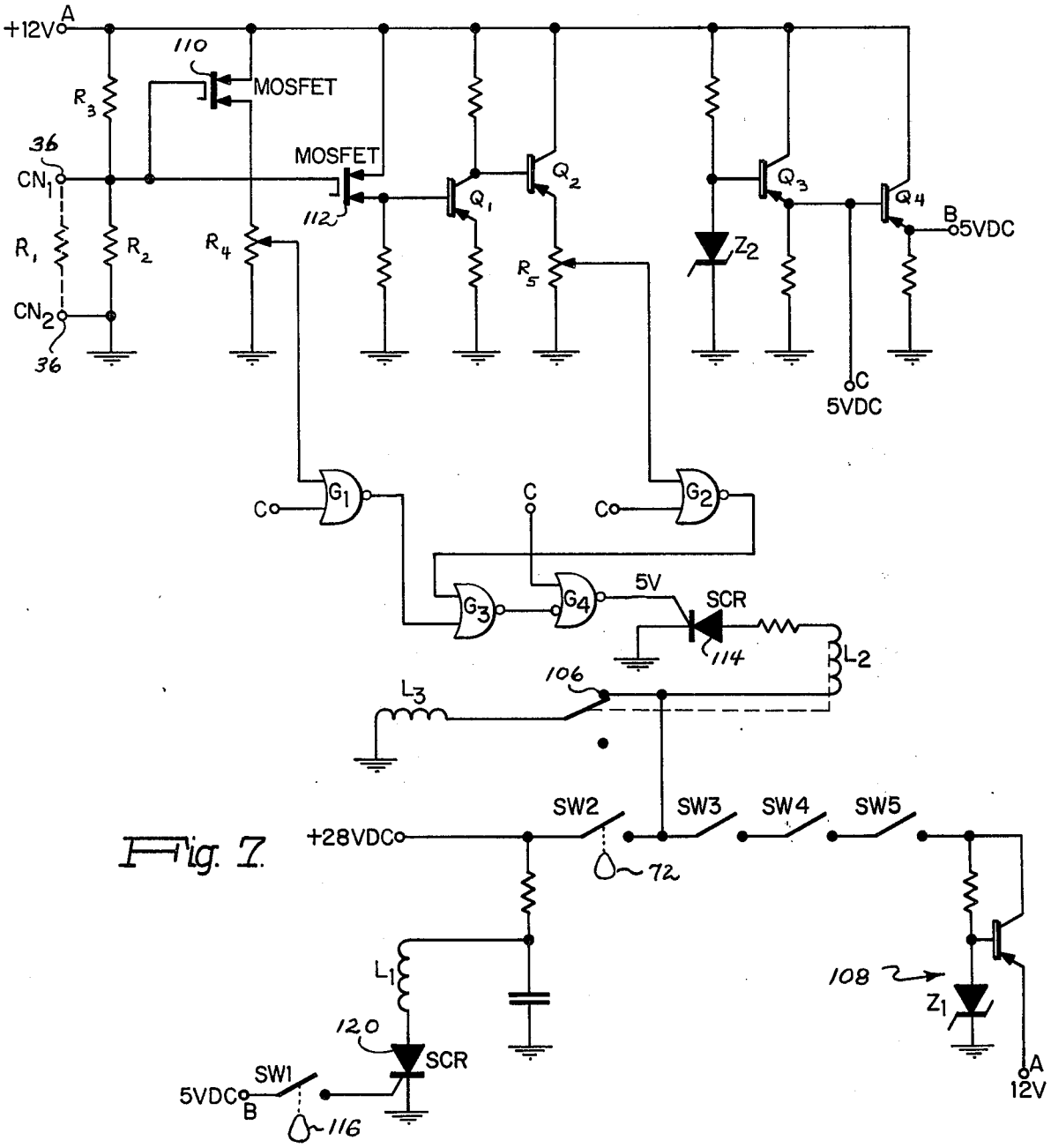

The electrical circuitry for controlling the operation of the thumb button gear train, electro-magnetically actuated brake 68 and the finger button assembly latching release solenoid 92 are shown in block diagram form in FIG. 6 and in schematic form in FIG. 7. A suitable power supply 98 such as, a rechargeable battery floated across the power mains, supplies power to the electrical components of the false alarm deterrent apparatus. The logical operation of the circuitry is shown in FIG. 6 by the arrows between the blocks in the diagram. A flesh sensor circuit 100 senses by electrical resistance the presence of a human finger across the finger button contacts 36. If the electrical resistance between the contacts corresponds to that associated with a human finger i.e. from 40K to 20 megohms, an output is applied from the flesh sensor 100 to an electronic logic circuit 102 which enables a fingerprint button release mechanism 104 that includes the previously mentioned solenoid 92, an alarm activator brake and mechanical override 106 that includes the previously mentioned thumb button gear train assembly brake 68 and an alarm activator 108.

Referring now to the detailed circuitry shown in the schematic diagram of FIG. 7, the thumb button gear train assembly brake solenoid coil $L_3$ is energized from a 28 volt DC source through the cam operated microswtich SW2 (Reference numeral 70 in FIG. 1) and through contact 106 on brake release relay $L_2$. The microswitch SW2 (70) is closed when the alarm sender presses thumb button 42 causing cam 72 to rotate and close the microswitch. The brake will remain engaged i.e. brake coil L3, will remain energized until the flesh sensor circuit 100 and electronic logic 102 determine that the flesh sensor contacts 36 are bridged by a resistance which corresponds to the resistance of a human finger and that all of the finger buttons 32 have been pressed.

Each finger button 32 closes an associated microswitch 38, identified in FIG. 7 as microswitches SW3, SW4 and SW5. The three finger button microswitches are wired in series and when closed apply 28 volt DC power to a regulator ciricuit indicated generally as 108 which produces a 12 volt DC output. The regulated 12 volt DC output from regulator circuit 108 is applied to MOSFETs 110 and 112, and transistors $Q_1$ through $Q_4$. Transistors $Q_3$ and $Q_4$ in conjunction with Zener diode $Z_2$ form a five volt regulated DC supply having outputs identified by the letters "B" "C" in FIG. 7. The output B and C are connected to the correspondingly labeled connectors in the Figure. However, for purposes of clarity the actual wiring between connector points has been omitted from the schemetic.

MOSFETs 110 and 112 and transistors $Q_1$ and $Q_2$ comprises the flesh sensor circuit 100. This circuit senses the resistance across the finger button contacts 36 (indicated by the dashed resistor R1 in FIG. 7). If this resistance is within predetermined limits, a logic circuit comprising NAND gates G1 through G4 produces an output which triggers SCR 114 into conduction thereby energizing brake release relay coil $L_2$. When the brake release relay coil $L_2$ is energized, the power supply circuit to the thumb button gear train brake solenoid $L_3$ is broken and the brake 68 is released. Upon release of the brake 68, the user can further depress the thumb button until the alarm is actuated through the operation of the thumb button gear train assembly 40.

The flesh sensor circuit is designed to respond to resistances across the finger button contacts 36 within the range of 20K to 40 megohms. This resistance range encompasses the normal range of human finger resistance i.e. 40K to 20 megohms. Resistors R2 and R3 form a voltage divider for the input of MOSFET 110. When the human finger (represented by resistor R1) bridges the finger button contacts 36, the resistance in the lower leg of the voltage divider R2 – R3 is altered thereby changing the voltage applied to the inputs of MOSFETs 110 and 112. The source of MOSFET 112 is connected to the base of Q1 which operates as a single stage DC amplifier. Q2 is used as an emitter follower after the single stage of DC amplification.

The output voltages from MOSFET 110 and transistor Q2 are taken from potentiometers R4 and R5 and are applied as inputs respectively to NAND gates G1 and G2. It will be appreciated by those skilled in the art that with a suitable selection of the resistances R2 and R3, R4 and R5, the semiconductor and the biasing resistors, the circuit can be adjusted to cover the desired resistance range for the finger resistance R1. Specific values for the components are not deemed necessary because those skilled in the art can implement the circuit and circuit function in a variety of known ways.

With a finger bridging the finger button contacts 36, the output voltage at the center arm of potentiometer R4 will drop, giving a low or 0 on one input of NAND gate G1. Since the other input to gate G1 is tied to the regulated 5 volt DC supply "C", the output from G1 will be high or 1. The converse is true with respect to NAND gate G2 which produces a low (0) output when the finger resistance bridges contacts 36. The outputs of gates G1 and G2 are applied as inputs to NAND gate G3. Since the presence of a finger resistance across contacts 36 will produce a high or 1 ouput from gate G1 and a low or 0 output from gate G2, gate G3 produces a high or 1 output. The output from gate G3 is inverted and applied as an input to gate G4. The other input to gate G4 is tied to the 5 volt DC supply C. The resulting output from NAND gate G4 is applied as a high 5 volt trigger to SCR 114.

With SCR 114 conducting, brake release relay L2 is energized thereby breaking the enegization path to the thumb button gear train assembly brake coil L3. Once the brake 68 has been released by the de-energization of brake coil L3, rack 44 is free to move further to the left as viewed in FIG. 4. The further movement of rack 44 rotates pinion gear 52 which in turn rotates pinion gear shaft 54. Shaft 54 is provided with a second cam 116 (FIG. 1) which closes a microswitch 118 (SW 1 in FIG. 7). When microswitch SW1 is closed by cam 116, a 5 volt trigger from the 5 volt DC supply B is applied to SCR 120. With SCR 120 conducting, the solenoid coil L1 of the latch assembly releasing solenoid 92 is energized. The energization of solenoid 92 as explained previously, moves solenoid arm 94 in a downwardly direction, as viewed in FIG. 5, thereby releasing the latch arm 82. When the latch arm is released, the finger button assembly 30 moves from the operative position shown by the solid lines in FIG. 5 to the retracted position shown by the dashed lines in FIG. 5.

The preceding discussion has been directed to a single flesh sensor circuit for one of the finger buttons 32. However, it is desirable to have a separate flesh sensor for each finger button. In this situation the flesh sensor portion of the schematic shown in FIG. 7 is duplicated for each finger button and the outputs from gates G4 are ANDed by an AND gate (not shown) whose output is used to trigger SCR 114.

It will be appreciated from the preceeding description that in the flase alarm deterrent apparatus or alarm activator of the present invention, the layout of the three finger buttons 32 and the thumb button 42 has been carefully arranged in accordance with ergonomics considerations. Referring to FIGS. 2 and 3, the buttons are spaced to accommodate the human hand. In addition, the finger buttons 32 are positioned to extend through a shaped spacer 122 having in side elevation a generally triangular configuration. The three finger buttons 32 are also partially covered by a cover 126. The combination of the triangular shaped spacer 122 and the cover 126 has the effect of forcing the alarm sender to use a single hand to press the finger and the thumb buttons. It has also been found that the spacer-cover-button configuration shown in FIGS. 2 and 3 seems to provide a self-explanatory, if not "symbolic" set of directions for the alarm user. The finger and thumb buttons preferably are further covered by a pivotally mounted transparent cover 126 which provides visual access to the buttons while protecting them from the environment. Having described in detail a preferred embodiment of our invention, it will now be apparent to those skilled in the art that numerous modifications can be made therein without departing from the scope of the invention as defined in the appended claims.

For example, the false alarm deterring alarm actuator of the present invention can be used with a variety of different types of alarm including the recently developed "voice alarms". The fingerprint obtaining portion can be used alone or in conjunction with the flesh sensor. Similarly, the flash sensor with or without the sequential finger button switches SW3, SW4 and SW5, can be used to insure the presence of a human finger. This has wide application in the field of "hands on" protective actuators e.g. the hands on power switch for machine presses and punches.

What we claim and desire to secure by Letters Patent of the United States is:

1. A false alarm deterring actuator for an alarm comprising:

1. a housing;
2. fingerprint receiving means movably mounted with respect to said housing, said fingerprint receiving means having a plurality of movable finger button means each having a fingerprint receiving surface thereon;
3. means for moving said fingerprint receiving means from an operative position in which the fingerprint receiving means is accessible to an alarm sender to a retracted position within the housing in which the fingerprint receiving means is inaccessible to the alarm sender; and,
4. means responsive to pressure exerted on said fingerprint receiving means for (i) causing said moving means to move the fingerprint receiving means from the operative position to the retracted position and, (ii) actuating the alarm.

2. The alarm actuator of claim 1 wherein said pressure responsive means includes logic means, said logic means preventing said pressure responsive means from operating unless pressure is exerted on all of said movable finger button means at the same time.

3. The alarm actuator of claim 2 wherein said pressure responsive means is responsive to pressure exerted by a human finger.

4. The alarm actuator of claim 2 wherein said pressure responsive means includes at least one pair of spaced electrical contacts on one of said movable finger button means and electrical means responsive to a bridging resistance between said contacts in the range of 20K–40 megohms for permitting said pressure response means to actuate the alarm.

5. The alarm actuator of claim 4 wherein said pressure responsive means includes a thumb button actuated gear train means, brake means for braking said gear train, means responsive to a predetermined initial movement of the gear train means for actuating said gear train braking means, and brake release means responsive to said bridging resistance responsive means whereby the gear train brake means is released when a bridging resistance within said resistance range bridges said electrical contacts.

6. The alarm actuator of claim 5 wherin said brake means is electrically actuated and is in the disengaged position in the absence of electrical power.

7. The alarm actuator of claim 5 wherein the thumb button of the gear train means and the movable finger button means are positioned in spaced relation corresponding respectively to the thumb and at least one of the following fingers of a human hand: index, middle and ring.

8. The alarm actuator of claim 7 wherein said movable finger button means and the thumb button of the gear train means are located substantially within a plane and a spacer means is positioned between the thumb button and the finger buttons, said spacer means having a generally triangular cross-section in a plane perpendicular to the plane of said thumb button and finger button means with the apex of the triangular cross-section facing towards the hand of the alarm user when the user presses the thumb button and the finger button means.

9. The alarm actuator of claim 8 wherein at least a portion of the finger button means is covered by a cover which extends outwardly from the plane of said thumb button and finger button means toward the user of the alarm.

10. A false alarm deterring actuator for an alarm comprising:

1. a housing;
2. fingerprint receiving means movably mounted with respect to said housing;
3. means for moving said fingerprint receiving means from an operative position in which the fingerprint receiving means is accessible to an alarm sender to a retracted position within the housing in which the fingerprint receiving means is inaccessible to the alarm sender;
4. a thumb button actuated gear train means for actuating the alarm after a predetermined movement of the gear train;
5. means responsive to the movement of said gear train for causing said moving means to move the fingerprint receiving means from the operative position to the retracted position.

11. The alarm actuator of claim 10 further comprising brake means for braking said gear train, means responsive to a predetermined initial movement of the gear train means for actuating said gear train braking means, and brake release means responsive to pressure exerted on said fingerprint receiving means for releasing said gear train brake.

12. The alarm actuator of claim 11 wherein said predetermined initial movement of the gear train is less than the predetermined movement of the gear train which activates the alarm.

13. The alarm actuator of claim 11 wherein said fingerprint receiving means includes a plurality of movable finger button means each having a fingerprint receiving surface thereon, and wherein the brake release means includes logic means to prevent the brake release means from operating unless pressure is exerted on all of said movable finger buttons at the same time.

14. The alarm actuator of claim 13 wherein said brake release means includes at least one pair of spaced electrical contacts on one of said movable finger button means and electrical means responsive to a bridging resistance between said contacts in the range of 20K–40 megohms for permitting said brake release means to release the gear train brake means.

15. A method for deterring false alarms comprising the steps of:

1. positioning a plurality of movable fingerprint receiving finger button switches at an alarm actuator so that the finger button switches are accessible to an alarm sender, said finger button switches all having to be pressed in order to actuate an alarm; and after the fingerprint button switches have been pressed by the alarm sender;
2. moving the finger button switches to a position at the alarm actuator in which the finger button switches are inaccessible to the alarm sender.

16. A false alarm deterring actuator for an alarm comprising:

1. a housing;
2. fingerprint receiving means movably mounted with respect to said housing, said fingerprint receiving means having a plurality of movable finger button means each having a fingerprint receiving surface thereon;
3. means for moving said fingerprint receiving means from an operative position in which the fingerprint receiving means is accessible to an alarm sender to a retracted position within the housing in which the fingerprint receiving means is inaccessible to the alarm sender; and,
4. means responsive to pressure exerted by a human finger on said fingerprint receiving means for (i) causing said moving means to move the fingerprint receiving means from the operative position to the retracted position and, (ii) actuating the alarm.

17. The alarm actuator of claim 16 wherein said pressure responsive means includes a movable thumb button and controllable means responsive to a predetermined movement of the thumb button for actuating the alarm.

18. The alarm actuator of claim 17 further comprising means responsive to a predetermined initial movement of the thumb button for preventing said controllable means from actuating the alarm, and means responsive to pressure exerted on said fingerprint receiving means for permitting said controllable means to actuate the alarm.

19. The alarm actuator of claim 18 wherein said pressure responsive means includes at least one pair of spaced electrical contacts on one of said movable finger button means and electrical means responsive to a bridging resistance between said contacts in the range of 20K-40 megohms for permitting said pressure responsive means to actuate the alarm.

20. The alarm actuator of claim 17 wherein the thumb button and the movable finger button means are positioned in spaced relation corresponding respectively to the thumb and at least one of the following fingers of a human hand: index, middle and ring.

21. The alarm actuator of claim 17 wherein said movable finger button means and said thumb button are located substantially within a plane and a spacer means is positioned between the thumb button and the finger buttons, said spacer means having a generally triangular cross-section in a plane perpendicular to the plane of said thumb button and finger button means with the apex of the triangular cross-section facing towards the hand of the alarm user when the user presses the thumb button and the finger button means.

22. The alarm actuator of claim 21 wherein at least a portion of the finger button means is covered by a cover which extends outwardly from the plane of said thumb button and finger button means toward the user of the alarm.

23. The alarm actuataor of claim 16 wherein said pressure responsive means includes logic means, said logic means preventing said pressure responsive means from operating unless pressure is exerted on all of said movable finger button means at the same time.

24. A false alarm deterring actuator for an alarm comprising:

1. a housing;
2. fingerprint receiving means movably mounted with respect to said housing;
3. means for moving said fingerprint receiving means from an operative position in which the fingerprint receiving means is accessible to an alarm sender to a retracted position within the housing in which the fingerprint receiving means is inaccessible to the alarm sender;
4. movable finger button means for actuating the alarm after a predetermined movement of the finger button means;
5. means responsive to the movement of said finger button means for causing said moving means to move the fingerprint receiving means from the operative position to the retracted position.

25. The alarm actuator of claim 24 wherein said fingerprint receiving means includes at least one movable fingerprint button means having a fingerprint receiving surface thereon.

26. The alarm actuator of claim 25 wherein the finger button and the movable fingerprint button means are positioned in spaced relation corresponding respectively to the thumb and at least one of the following fingers of a human hand: index, middle and ring.

27. The alarm actuator of claim 25 wherein said movable fingerprint button means and said finger button are located substantially within a plane and a spacer means is positioned between the finger button means and the fingerprint button means, said spacer means having a generally triangular cross-section in a plane perpendicular to the plane of said finger button means and said fingerprint button means with the apex of the triangular cross-section facing towards the hand of the alarm user when the user presses the finger button means and the fingerprint button means.

28. The alarm actuator of claim 24 further comprising brake means for braking said movable finger button means, means responsive to a predetermined initial movement of the finger button means for actuating said braking means, and brake release means responsive to pressure exerted on said fingerprint receiving means for releasing said brake means.

29. The alarm actuator of claim 28 wherein said predetermined initial movement of the finger button means is less than the predetermined movement of the finger button means which activates the alarm.

30. The alarm actuator of claim 28 wherein said brake release means includes at least one pair of spacer electrical contacts on said at least one movable fingerprint button means and electrical means responsive to a bridging resistance between said contacts in the range of 20 k- 40 megohms for permitting said brake release means to release the finger button brake means.

31. The alarm actuator of claim 30 further comprising a plurality of movable fingerprint button means each having a fingerprint receiving surface thereon and wherein said brake release means includes logic means to prevent the brake release means from operating unless pressure is exerted on all of said movable fingerprint button means at the same time.

32. The alarm actuator of claim 28 wherein said brake means is electrically actuated and is in the disengaged position in the absence of electrical power.

* * * * *